US007104673B2

(12) United States Patent
Yu

(10) Patent No.: US 7,104,673 B2
(45) Date of Patent: Sep. 12, 2006

(54) CLAMP LAMP

(76) Inventor: Shu-Feng Yu, 11F., No. 14, Lane 71, Ande St., Sindian City, Taipei County (TW)

( * ) Notice: Subject to any disclaimer, the term of this patent is extended or adjusted under 35 U.S.C. 154(b) by 72 days.

(21) Appl. No.: 10/963,802

(22) Filed: Oct. 14, 2004

(65) Prior Publication Data

US 2006/0083008 A1 Apr. 20, 2006

(51) Int. Cl.
*F21V 21/00* (2006.01)

(52) U.S. Cl. ..... 362/396; 362/191

(58) Field of Classification Search ..... 362/190, 362/191, 396, 418, 430
See application file for complete search history.

(56) References Cited

U.S. PATENT DOCUMENTS 5,163,752 A * 11/1992 Copeland et al. ..... 362/396
5,664,875 A * 9/1997 Hegedus ..... 362/191
5,823,657 A * 10/1998 Price et al. ..... 362/191
6,951,408 B1 * 10/2005 Stewart ..... 362/183

* cited by examiner

*Primary Examiner*—Ali Alavi
(74) *Attorney, Agent, or Firm*—Bacon & Thomas

(57) ABSTRACT

The present invention is to provide a clamp lamp comprising a first side plate, a second side plate and a lateral plate, wherein the lateral plate connects the first side plate and the second side plate, thereby forming a retaining space between the first side plate and the second side plate. A lamp is disposed on the first side plate opposite to the second side plate and powered by at least a battery installed in a battery holder formed on the clamp. A light source can thus be generated from a light emitting portion of the lamp. A screw rod is disposed on the second side plate and connected with a mobile portion. By adjusting the amount of the screw rod inserted into the retaining space, the clamp can firmly grab an object, so as to securely fasten the lamp onto the object.

13 Claims, 3 Drawing Sheets

CLAMP LAMP

BACKGROUND OF THE INVENTION

1. Field of the Invention

The present invention relates to a lamp, more particularly to a lamp having a clamp capable of firmly grab an object, so as to securely fasten the lamp onto the object.

2. Prior Art of the Invention

Referring to FIG. 1, a conventional grill oven 10 is illustrated. As shown, the grill oven 10 comprises an oven body 11 and an oven stand 12. The opposite side walls of the oven body 11 comprises a motor 132 and a stick mount 133 disposed thereon for connecting one end of a grill stick 131 with the motor 132 and the other end of the grill stick 131 with the stick mount 133. The grill stick 131 can thus be rotated on the oven body 11 following the rotation of the motor 132. On the other hand, a shelf 121 is formed on the oven stand 12 adjacent the oven body 11, which may be used to place food (e.g. sheep meat or pork, not shown) or grill tools (e.g. fork or barbecue souse, not shown) that is required for barbecue.

Additionally, a lamp 14 may be disposed on the shelf 121. The lamp 14 comprises a lamp cover 141, a base 142, a light bulb 143 and a connection portion 144, wherein the lamp cover 141 and the connection portion 144 are connected with each other. The other end of the connection portion 144 is connected to the base 142, and the light bulb 143 is installed in the lamp cover 141, connecting with the connection portion 144. In addition, a power cord 145 is provided, which connects an outlet 147 on a wall 146 with the light bulb 143 through the base 142 and the connection portion 144. The light bulb 143 can thus receive electrical power from the outlet 147, thereby illuminating a light source. In this manner, one can employ the light of the lamp 14 to clearly see what is illuminated when using the grill oven 10 during night times or in dark spaces.

However, the lamp 14 as set forth above requires the outlet 147 being adjacent to the grill oven 10, so as to provide electrical power to the lamp 14 through the power cord 145. On the other hand, one also needs to watch out the possibility that the lamp 14 is fallen down, which largely reduces the enjoyment of cooking outside.

SUMMARY OF THE INVENTION

According to the description of the conventional lamp as set forth above, the conventional lamp requires an outlet for providing the necessary electrical power. On the other hand, the placement of the conventional lamp on a shelf is quite unstable.

It is thus an object of the present invention to provide a clamp lamp that has a clamp. The clamp comprises a first side plate, a second side plate and a lateral plate. The lateral plate connects the first side plate and the second side plate, thereby forming a retaining space between the first side plate and the second side plate. A lamp is disposed on the first side plate opposite to the second side plate. The lamp is powered by at least a battery installed in a battery holder formed on the clamp. A light source can thus be generated from a light emitting portion of the lamp. On the other hand, a screw rod is disposed on the second side plate. The screw rod is inserted into the retaining space and connected with a mobile portion. By adjusting the amount of the screw rod inserted into the retaining space, the clamp can firmly grab an object, so as to securely fasten the lamp onto the object The above and other objects, features and advantages of the present invention will become apparent from the following detailed description taken in conjunction with the accompanying drawings.

DETAILED DESCRIPTION OF THE PREFERRED EMBODIMENTS

Figure 1:
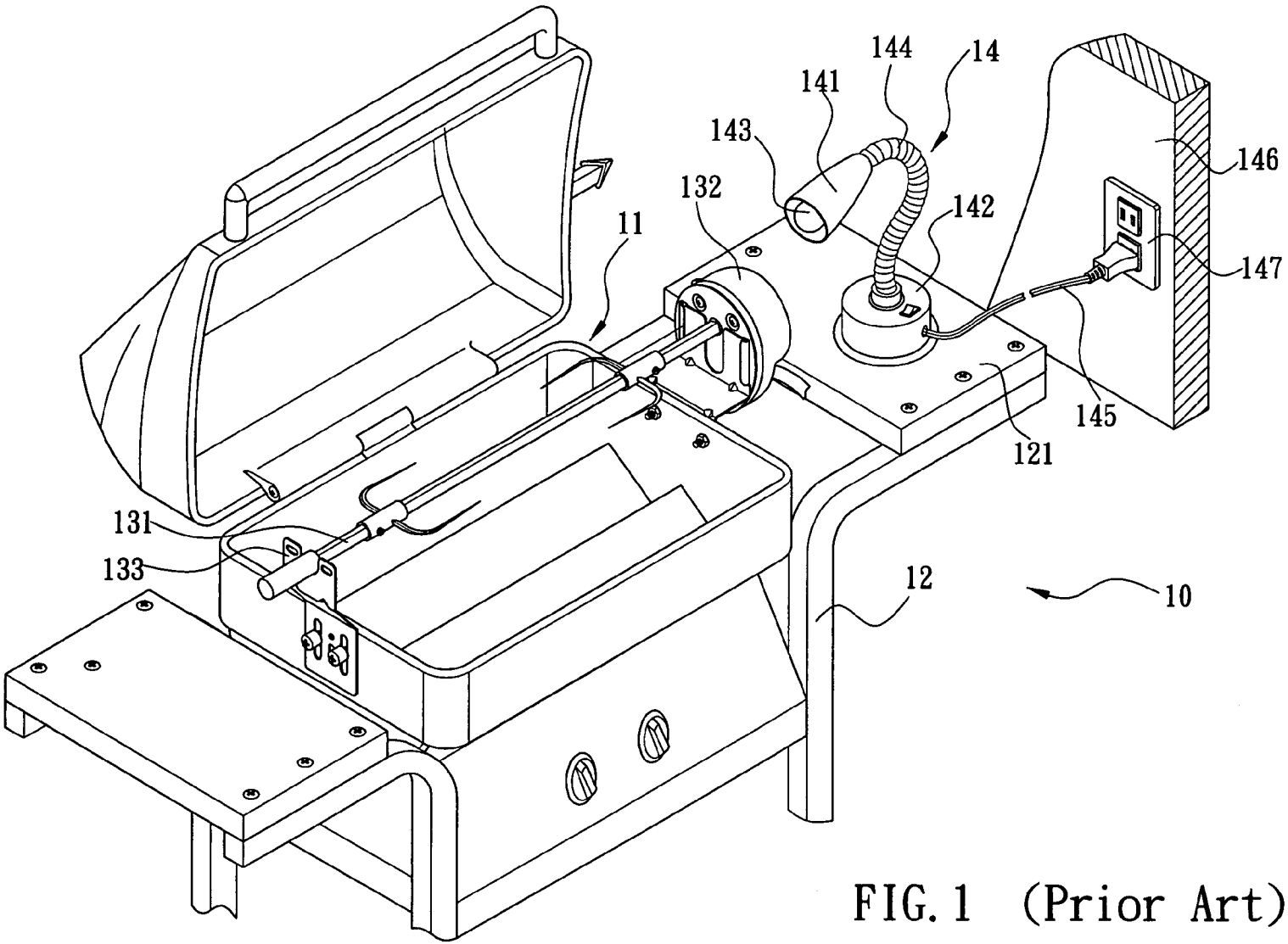
FIG. 1 (Prior Art)
FIG. 1 illustrates a conventional lamp used for a grill oven.
Figure 2:
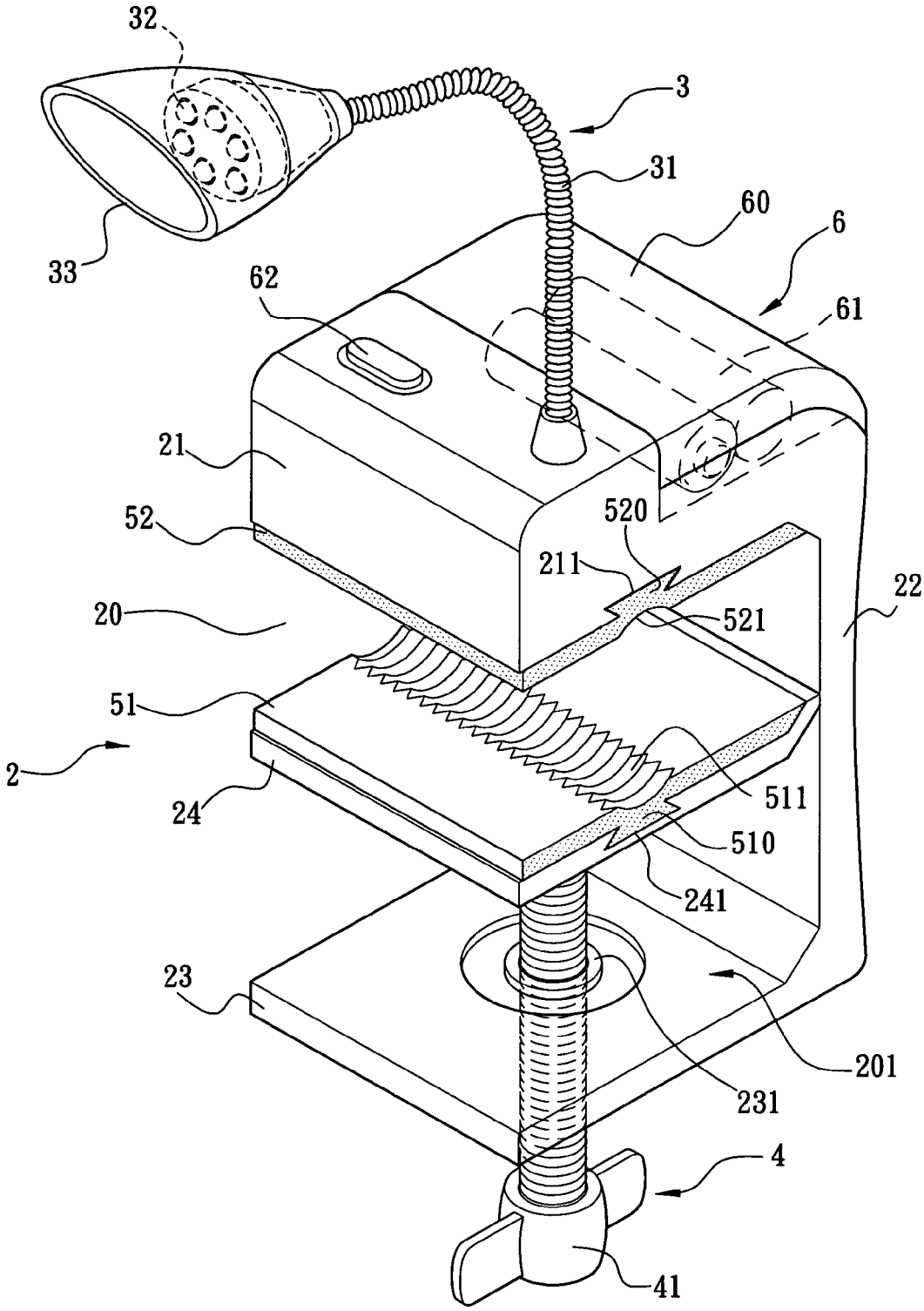
FIG. 2 illustrates a perspective view of a lamp of the present invention.
Figure 3:
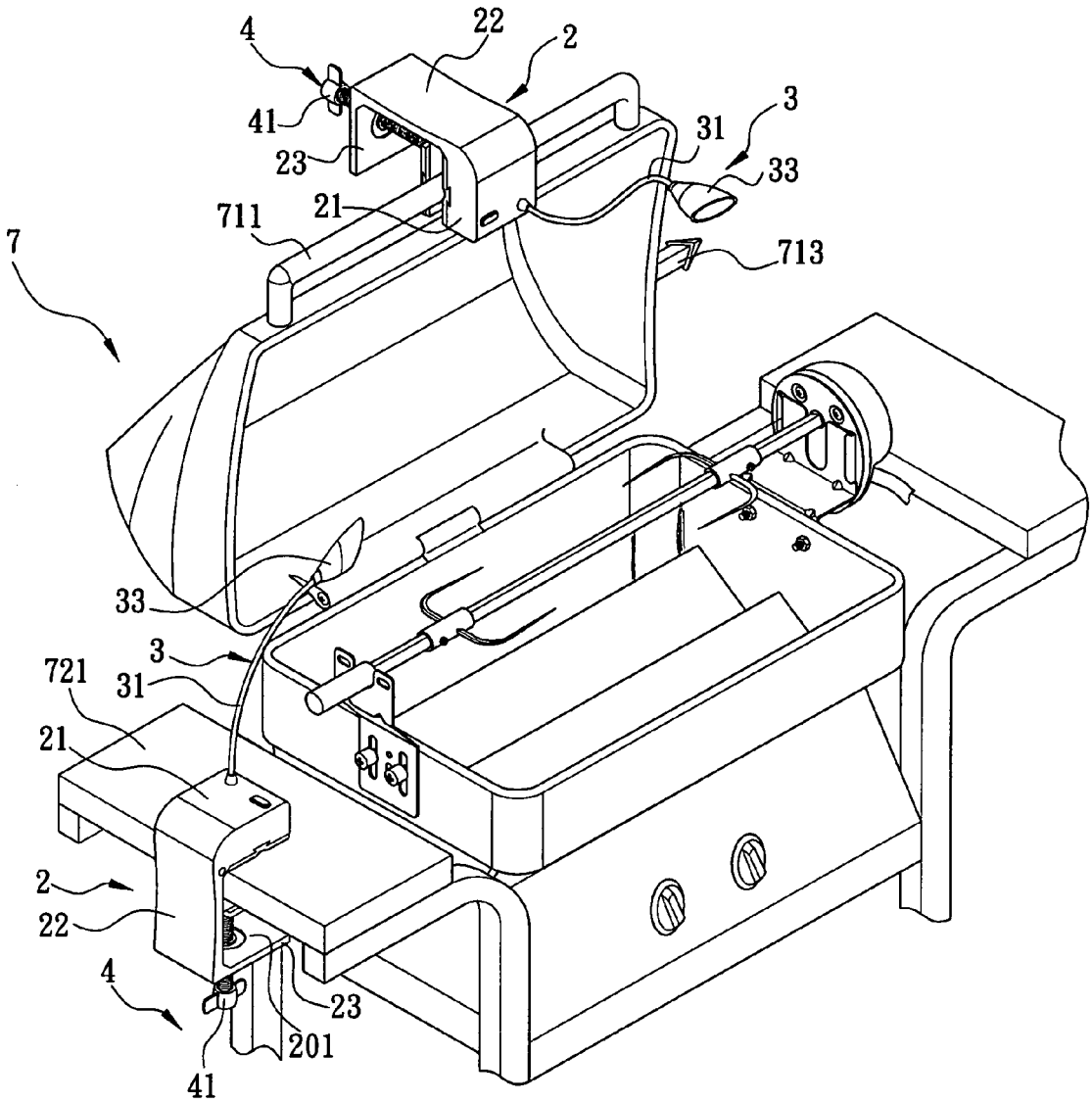
FIG. 3 illustrates a perspective view of the lamp of the present invention in combination with a grill oven.

Referring to FIG. 2, a perspective view of a lamp 3 of the present invention is illustrated. The lamp 3 is in combination with a clamp 2. The lamp 3 is disposed on one side of the clamp 2, while a screw rod 4 is disposed on the other side of the clamp 2. One end of the screw rod 4 may be inserted into the space 201 formed between the two sides of the clamp 2. A battery holder 6 is formed on the clamp 2 adjacent the lamp 3. The battery holder 6 can provide at least a battery 61 to be installed therein. The electrical power of the battery is transferred to the lamp 3 through the battery holder 6. A light emitting portion 32 is formed on the lamp 3, which can provide a light source. By rotating the screw rod 4, it can reach into or retract from the space 201. One end of the screw rod 4 can thus move towards one or the other side of the clamp 2. The clamp 2 can securely grab an object, thereby securely fastening the lamp 3 on the object. Referring to FIG. 3, the object can be a shelf 721 of a particular thickness, a rod 711, 713 of a particular radius (e.g. cylindrical rod, triangular rod, rectangular rod, or hexagonal rod), or any other object that the space 201 of the clamp 2 can grab.

Referring again to FIG. 2, the clamp 2 comprises a first side plate 21, a second side plate 23 and a lateral plate 22. The first side plate 21 and the second side plate 23 are opposite to each other, both being connected to side rims of the lateral plate 22. Consequently, a retaining space 201 is formed between the first side plate 21 and the second side plate 23. In addition, an opening 20 opposite to the lateral plate 22 is formed between the first side plate 21 and the second side plate 23. The clamp 2 is now in a C-shape. Thus, the clamp 2 can be installed on the shelf 721 of the grill oven 7, as shown in FIG. 3, by the retaining space 201 through the opening 20.

In addition, the lamp 3, the battery holder 6 and a power switch 62 are disposed on one surface of the first side plate 21 not facing the second side plate 23. The lamp 3 further comprises an extension tube 31 and a lamp cover 33. The light emitting portion 32 is disposed in the lamp cover 33, connecting one end of the extension tube 31. The other end of the extension tube 31 is connected to the battery holder. The light emitting portion 32 in this particular embodiment can be a high brightness light emitting diode (HB LED) or a krypton light bulb. Furthermore, the extension tube 31 on the clamp 2 can be bent to any arbitrary angle or direction as needed.

The battery holder 6 comprises a battery cover 60, which can be taken away from the clamp 2 for installing at least a battery 61 (e.g. a lithium battery or a zinc manganese dry battery) in the battery holder 6. After connecting the battery cover 61 back with the clamp 2 for shielding the battery 61, one can turn on or off the power switch 62 for allowing the electric power of the battery 61 to be conducted to the light emitting portion 32 through the extension tube 31, thereby generating a light source from the light emitting portion 32. In addition, the lamp cover 33 can focus the generated light source within a specific area, which can largely reduce the waste of electrical power due to light dispersion. Since the extension tube 31 can be arbitrarily bent, the light source emitted from the light emitting portion 32 can thus be projected to any proper place as desired. Furthermore, the screw rod 4 that penetrates through the second side plate 23 into the retaining space 201 faces one end of the retaining space 201. By rotating the screw rod 4, it can move towards the shelf 721, and securely sandwiching the shelf 721 in the retaining space 201. The clamp 2 is thus fastened onto the shelf 721.

Further, a mobile portion 24 is formed on one end of the screw rod 4 facing the retaining space 201. The mobile portion 24 can move between the retaining space 201. In addition, a first spacer 51 that comprises anti-slippery characteristics, such as silica-gel spacer or soft rubber, is formed on the mobile portion 24 facing the first side plate 21. A second spacer 52 is formed on the first side plate 21 facing the second side plate 23. The first spacer 51 and the second spacer 52 are so disposed to face with each other, and each forming a flat surface, an undulated surface, or a saw-toothed surface. Furthermore, a first dovetail groove 211 and a second dovetail groove 241 are formed respectively on central portion of the first side surface 21 and the mobile portion 24. While the first spacer 51 and the second spacer 52 comprises respectively a first protrusive portion 510 and a second protrusive portion 520, the protrusive portions 510, 520 are respectively disposed in the second dovetail groove 241 and the first dovetail groove 211. Therefore, the first spacer 51 and the second spacer 52 are difficult to slide on the first side plate 21 and the mobile portion 24.

Referring to FIG. 2, a first concave portion 511 and a second concave portion 521 are respectively formed on the first space 51 and the second spacer 52 corresponding to the location of the two dovetail grooves 211, 241. The rods 711, 713 of the grill oven 7, as shown in FIG. 3, can be used to provide a basis for the mobile portion 24 and the first side plate 21 being clamped thereon. The two concave portions 511, 521 and the two dovetail grooves 211, 241 are provided to firmly fasten the clamp 2 onto the rods 711, 713. Moreover, the surface of the two concave portions 511, 521 can be a flat surface, an undulated surface or a saw-toothed surface, such that the clamp 2 can tightly grab the rods 711, 713 without easily being slipped.

Referring again to FIG. 2, the second side surface 23 comprises a screw hole 231. One part of the screw rod 4 is inserted into the retaining space 201 through the screw hole 23. The screw rod 4 and the screw hole 231 are mutually engaged with each other. An actuating portion 41 is formed on one end of the screw rod 4 that obtrudes out of the clamp 2. By rotating the actuating portion 41, the screw rod 4 is rotated in the screw hole 231, thereby gradually moving the mobile portion 24 towards the lamp 3, or away from the lamp 3.

While the invention has been described by means of specific embodiments, numerous modifications and variations could be made thereto by those skilled in the art without departing from the scope and spirit of the invention set forth in the claims.

What is claimed is:

1. A clamp lamp comprising;

a clamp having a retaining space formed thereon for inserting an object therein, a first side plate and a second side plate;

a lamp that is disposed on one side of the clamp, the lamp comprising a light emitting portion;

a screw rod being movably disposed on another side of the clamp, one end of the screw rod being inserted into the retaining space, whereby the screw rod can move back and forth in the retaining space, and whereby one end of the screw rod can move towards the side of the clamp with the lamp disposed thereon or another side of the clamp;

a mobile portion is formed on one end of the screw rod facing the retaining space, so as to move the mobile portion following the movement of the screw rod;

a first spacer is formed on the mobile portion facing the first side plate, and a second spacer is formed on the first side plate facing the second side plate; and wherein a first dovetail groove and a second dovetail groove are respectively formed on the central portion of the first spacer and the second spacer, and a first protrusive portion and a second protrusive portion are respectively disposed into the first dovetail groove and the second dovetail groove.

2. The clamp lamp as recited in claim 1, wherein the clamp further comprises:

a lateral plate including a pair of opposite rims, wherein the opposite rims of the lateral plate are respectively connected to the first side plate and the second plate, thereby forming the retaining space between the first side plate and the second side plate, and wherein an opening is formed between the first side plate and the second side plate opposite to the lateral plate.

3. The clamp lamp as recited in claim 2, wherein the lamp, the battery holder and a power switch are formed on the first side plate not facing the second side plate, and wherein the lamp further comprises:

a lamp cover covering the light emitting portion for focusing the light source generated from the light emitting portion;

an extension tube, one end of the extension tube connecting the light emitting portion and the other end of the extension tube coupling with the battery holder; wherein the battery holder comprising a battery cover that is detachable from the clamp for installing at least a battery therein and shielding the battery; and wherein the power switch controls the electrical power of the battery to be conducted to the light emitting portion through the extension tube.

4. The clamp lamp as recited in claim 3, wherein the extension tube is bent on the clamp.

5. The clamp lamp as recited in claim 2, wherein a screw hole is formed on the second side plate for inserting one part of the screw rod into the retaining space therethrough.

6. The clamp lamp as recited in claim 1, wherein an actuating portion is formed on one end of the screw rod obtruding out of the clamp.

7. The clamp lamp as recited in claim 1, wherein the surface of the first spacer and the second spacer facing with each other is a flat surface.

8. The clamp lamp as recited in claim 1, wherein the surface of the first spacer and the second spacer facing with each other is an undulated surface.

9. The clamp lamp as recited in claim 1, wherein the surface of the first spacer and the second spacer facing with each other is a saw-toothed surface.

10. The clamp lamp as recited in claim 1, wherein a first concave portion and a second concave portion are respectively formed on the first spacer and the second spacer corresponding respectively to the locations of the first dovetail groove and the second dovetail groove.

11. The clamp lamp as recited in claim 10, wherein the surface of the first concave portion and the second concave portion facing with each other is a flat surface.

12. The clamp lamp as recited in claim 10, wherein the surface of the first concave portion and the second concave portion facing with each other is a saw-toothed surface.

13. The clamp lamp as recited in claim 10, wherein the surface of the first concave portion and the second concave portion facing with each other is an undulated surface.

* * * * *